US005601529A

United States Patent [19]

Wollman

[11] Patent Number: 5,601,529

[45] Date of Patent: Feb. 11, 1997

[54] FINGER MASSAGE APPARATUS

[75] Inventor: Matt J. Wollman, North Hollywood, Calif.

[73] Assignee: HWE, Inc., North Hollywood, Calif.

[21] Appl. No.: 422,879

[22] Filed: Apr. 17, 1995

[51] Int. Cl.[6] ..... A61H 11/00; A61H 23/06

[52] U.S. Cl. ..... 601/74; 601/70; 601/81

[58] Field of Search ..... 601/46, 69–74, 601/78–81

[56] References Cited

U.S. PATENT DOCUMENTS

| | | | |
|---|---|---|---|
| 524,120 | 8/1894 | Speare . | |
| 695,971 | 3/1902 | Turck . | |
| 818,618 | 4/1906 | Fraley | 601/74 |
| 1,497,840 | 6/1924 | Clement | 601/79 X |
| 1,498,680 | 6/1924 | Clement et al. . | |
| 1,539,299 | 5/1925 | Cheney . | |
| 1,545,413 | 7/1925 | Elmvall . | |
| 1,915,721 | 6/1933 | Diaz . | |
| 1,918,458 | 7/1933 | Dremel . | |
| 2,228,934 | 1/1941 | Tjomsland | 601/74 |
| 2,644,446 | 7/1953 | Viniegra | 128/41 |
| 2,703,571 | 3/1955 | Thomas | 128/36 |
| 2,918,055 | 12/1959 | Boerger | 128/41 |
| 3,310,050 | 3/1967 | Goldfarb | 601/79 |
| 3,461,859 | 8/1969 | Fortnam | 601/74 |
| 3,623,481 | 11/1971 | Curran | 601/74 |
| 3,671,785 | 6/1972 | Fuchs et al. | 601/74 X |
| 4,052,981 | 10/1977 | Buchmann | 601/71 |
| 4,173,217 | 11/1979 | Johnston | 128/734 |
| 4,343,303 | 8/1982 | Williams | 601/46 |
| 5,016,616 | 5/1991 | Hu | 601/46 |
| 5,067,478 | 11/1991 | Berlant | 128/24.5 |
| 5,070,862 | 12/1991 | Berlant | 128/24.5 |
| 5,519,292 | 5/1996 | Taylor et al. | 601/80 X |

FOREIGN PATENT DOCUMENTS

| | | | |
|---|---|---|---|
| 1195125 | 11/1959 | France | 601/79 |
| 2058662 | 3/1972 | Germany | 601/74 |
| 506700 | 4/1956 | Italy | 601/74 |
| 645147 | 10/1950 | United Kingdom | 601/74 |

OTHER PUBLICATIONS

Sharper Image Catalog, Sharper Image SPA, Spring 1995, p. 48, received USPTO Mar. 11, 1995.

The Sharper Image Catalog, Sharper Image Spa, Aug. 1994, cover and p. 3.

*Primary Examiner*—Danton D. DeMille

[57] ABSTRACT

A resilient covering panel is adapted to be placed upon the back of a user's hand. The forward portion of the covering member is divided into a pair of extensions, one being adapted to be placed adjacent the top of the user's middle finger, the second being adapted to be placed adjacent the top of the user's thumb. The rearward portion of the covering panel is integral with straps to be secured about the user's wrist. First and second direct current, vibrating motors are mounted within respective motor housings and are disposed through and coupled to the middle finger and thumb extensions. Securing members are affixed to the lower surfaces of each of the motor housings into which the user's middle finger and thumb may be inserted to secure the extensions in place. A pair of vibration controllers are mounted within a controller enclosure adjacent the base of the user's fingers. The vibration controllers are coupled to the first and second vibrating motors respectively, each being used to control the speed, magnitude of vibration and the inter-relationship between the operation of the vibrating motors.

13 Claims, 2 Drawing Sheets

Fig. 3
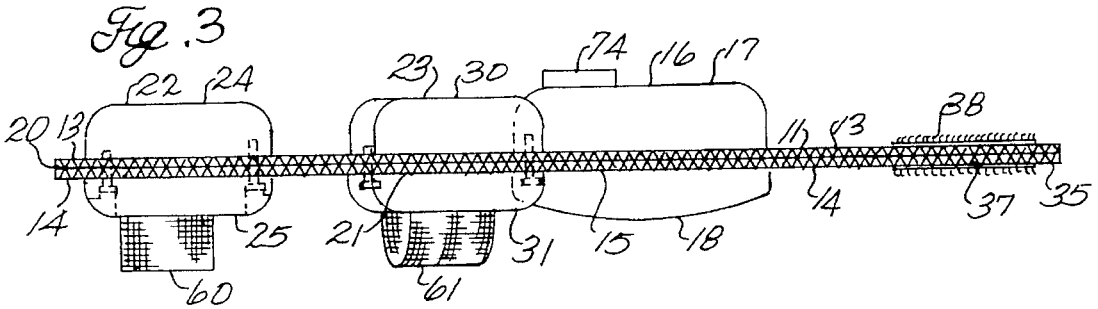
Fig. 4
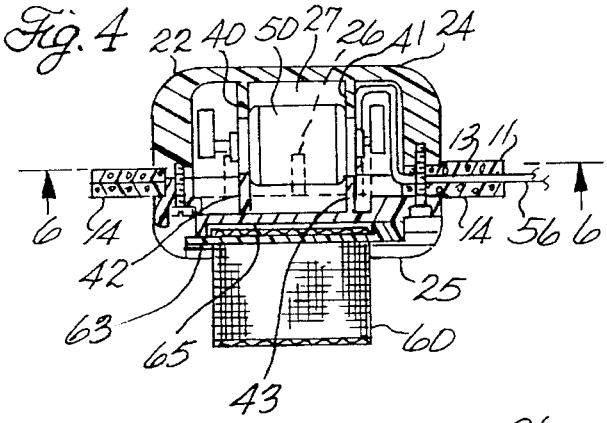
Fig. 5
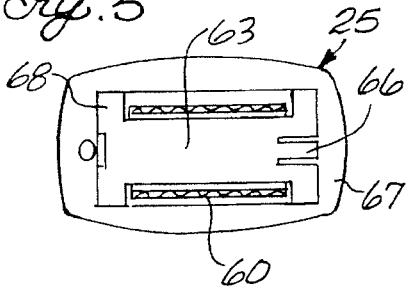
Fig. 6
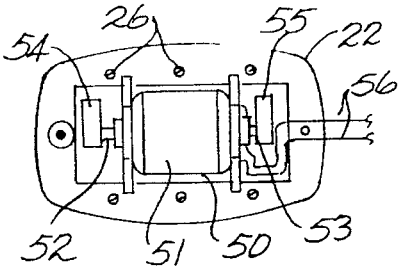
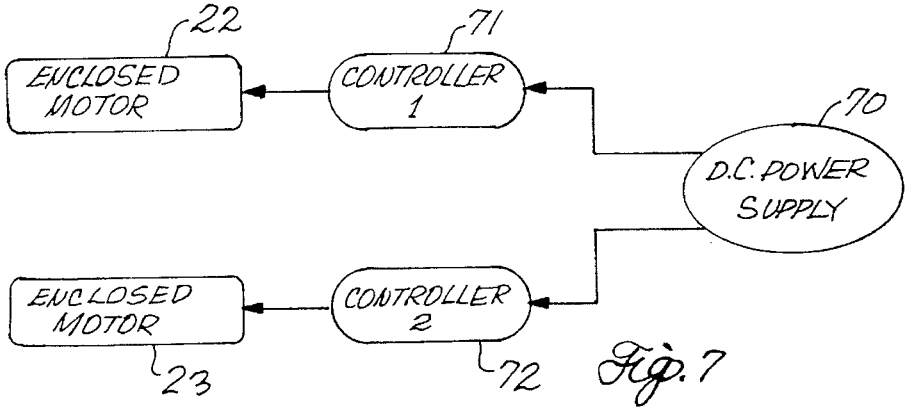
Fig. 7

FINGER MASSAGE APPARATUS

FIELD OF THE INVENTION

The present invention generally relates to a personal massaging apparatus and, more particularly, to a massage apparatus which is secured to the back of the user's hand and transmits vibratory motion through the fingers of the user.

BACKGROUND OF THE INVENTION

A variety of hand-held, electric motor-driven vibrators and massage apparatus are known. In a common design, an applicator or pedestal is affixed to the back of the back of the user's hand, but the motor is not attached to the applicator. Instead, the motor is secured to a stand and the motor drive shaft is connected to the applicator by a flexible shaft. This design is inadequate since use of the machine requires space for the positioning of the stand, and an operator's hand movement is limited to a specific area surrounding the stand.

In another type of finger massage apparatus, a single vibrating motor is secured to a pedestal, the bottom surface of the pedestal having a cushion or other resilient material affixed thereto. The resilient material is placed adjacent the top of the user's hand, and a plurality of resilient springs or other like cords affixed to the pedestal to form a loop about the cushion into which the user's hand is inserted. In use, the vibratory motion created by the motor will be transmitted through the pedestal and cushion to the user's hand and, to some extent, the user's fingers. The inadequacies of this category of finger massage apparatus are inherent in its design. By utilizing a single motor, the vibratory motion transmitted to the user's fingers is uniform and therefore unnecessarily limited.

Both types of vibratory massage apparatuses are cumbersome to use, and awkward in appearance, and provide a single point of vibratory contact with the region of the body being massaged. Neither is designed to transmit vibratory sensations directly through the fingertips of the user. What is needed is a mew type of vibratory massage apparatus, in which two or more vibrating sources provided vibratory sensations directly through the fingertips of a user or operator. Since a device should have an independent control for each vibrating motor, and should be simple and inexpensive to fabricate. Ideally, such a device should be more streamlined and, hence, more aesthetically pleasing in appearance and convenient to use, than prior known vibrating massage units.

SUMMARY OF THE INVENTION

The present invention substantially resolves the inadequacies inherent in the designs exhibited by the prior art by providing a finger massage apparatus comprising a self-contained massager which is adapted to be affixed to a hand and fingers of the user. Notably, the finger massage apparatus is designed to be worn, rather than held, by the user.

More particularly, a pliable, resilient covering member substantially in the form of a glove panel is adapted to be placed adjacent the top of the user's hand and conform thereto. A forward portion of the glove panel extends from a central segment, and is integral with and extends into elongated sections which substantially conform to the shape of the user's middle finger and thumb. The rearward portion of the glove panel extends from the central segment of the glove panel into a strap adapted to be secured about the wrist of the user. In a preferred embodiment, the glove panel has a two-ply construction and is made of a soft, yet durable material, such as neoprene. Thus, the glove panel forms a resilient cushion having a top and bottom surface.

First and second vibrating motors are coupled within their own respective motor housings, each of which is coupled to the middle finger and thumb extensions of the covering pane. Elastic straps, cords or the like are coupled to the motor housings for the purpose of receiving the thumb and middle finger of a user, and securing the glove member thereto. Thus, the finger massage apparatus has a plurality of vibrating members which are attachable at or near the tips of a user's finger(s) and thumb.

Each of the vibrating members is electrically coupled to respective controllers and a direct current power supply, or, "vibrating motor power source" and the controllers and power supply are mounted within a controller housing, which is secured within an enclosure or aperture mounted from the upper through the lower surface of the glove member intermediate the securing strap and middle finger and thumb extensions. The individual controllers permit a user to adjust the magnitude and rate of vibration of each vibrating motor, to suit the taste of the person receiving the massage.

The novel features which are believed to be characteristic of the invention, both as to its structure and method of operation, together with other features and advantages thereof, will be better understood from the following description considered in connection with the accompanying drawings in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWINGS

FIG. 3 is a side elevation view of the present invention finger massage apparatus shown in FIG. 2.

FIG. 4 is a partial cross-sectional view of a motor housing of the present invention finger massage apparatus shown in FIG. 2 taken through line 4—4 of FIG. 2 illustrating the interior compartment for mounting a vibrating motor.

FIG. 5 is a bottom plan view of a motor housing illustrating the member for mounting the elastic straps shown in FIG. 3 and FIG. 4.

FIG. 6 is a bottom plan view of the motor housing shown in FIG. 4 taken through line 6—6 of FIG. 4 illustrating the interior compartment for mounting a vibrating motor with eccentric cams.

FIG. 7 is a schematic block diagram of the power supply and controllers for the vibrating motors.

DETAILED DESCRIPTION

Figure 1:
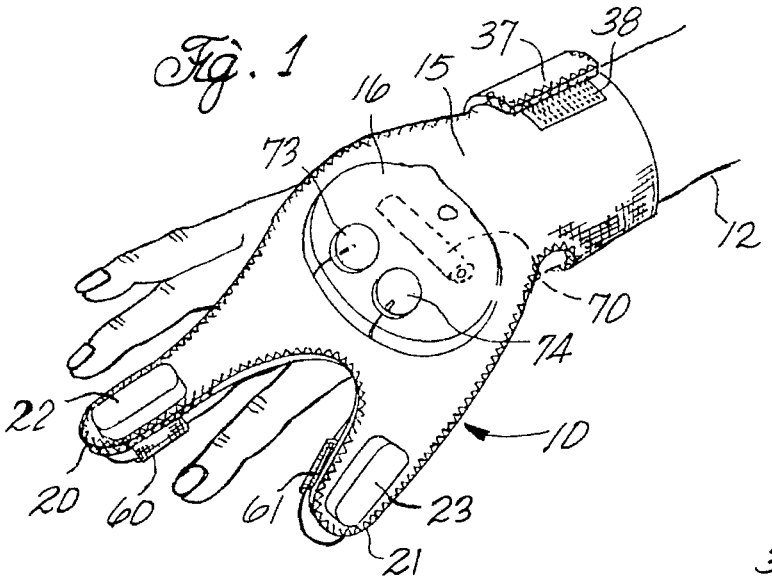
FIG. 1 is a perspective view of the present invention finger massage apparatus shown mounted upon the right hand of a user.
Figure 2:
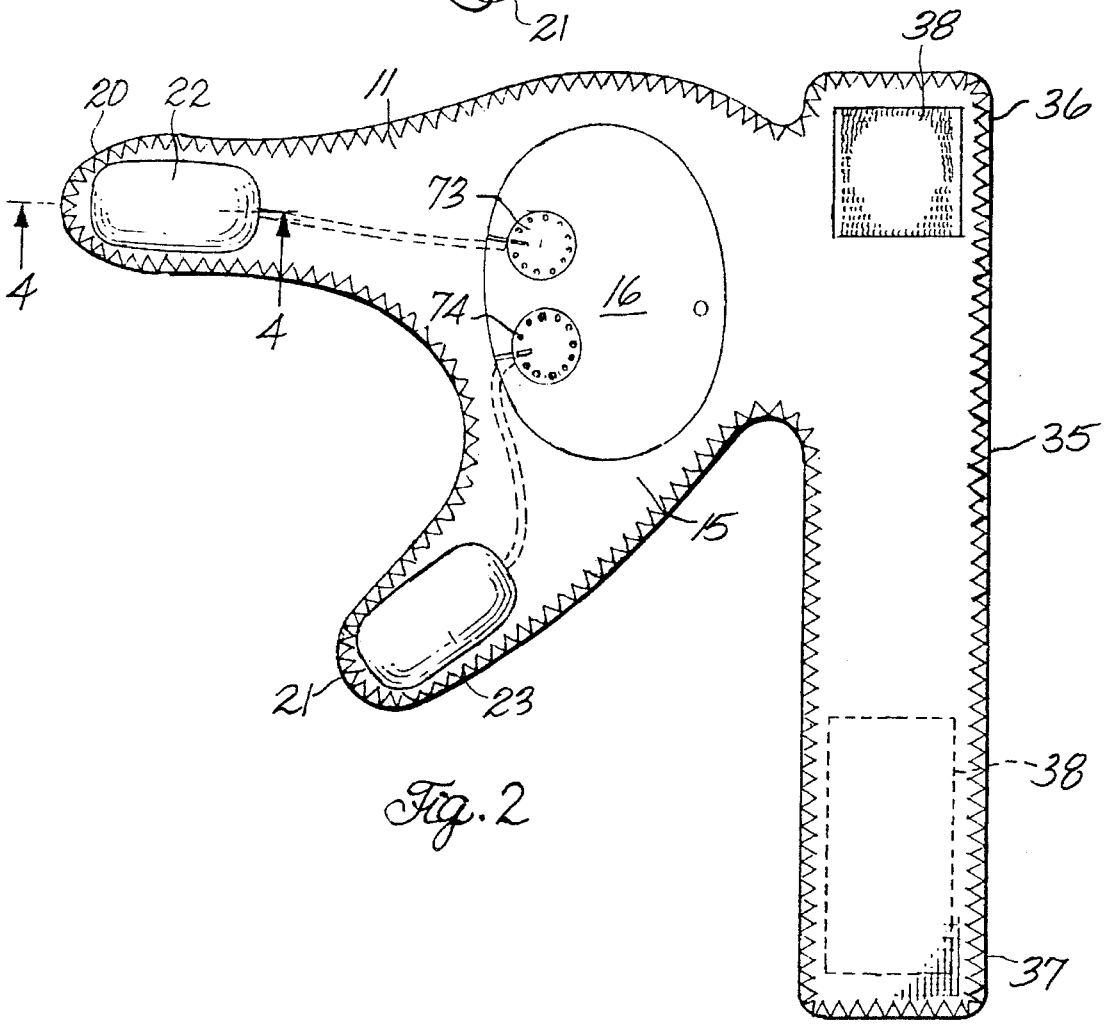
FIG. 2 is a top plan view of the present invention massage apparatus.

An understanding of the present invention finger massage apparatus may be best gained by reference to FIGS. 1, 2 and 3, wherein a preferred embodiment of the massage apparatus is generally designated by the reference numeral 10. Massage apparatus 10 is intended to provide means pursuant to which the vibratory motion of a plurality of vibrating motors is transmitted through the fingers of a user. Massage apparatus 10 employs a resilient, cushioning covering panel 11 which is in the form of a portion of a glove and is adapted to be placed adjacent the upper portion of the hand 12 of a user.

As can be seen in FIG. 3, covering panel 11 is constructed of top and bottom plies or layers 13 and 14 which are disposed adjacent one another. In the preferred embodiment of the present invention, top and bottom layers 13 and 14 are constructed from neoprene and joined together in a conventional manner by stitching or a suitable adhesive. It will be appreciated, however, that other soft and pliable, yet durable, materials can also be used.

As can be seen in FIG. 2, covering panel 11 includes a central segment 15 which is adapted to lie on the back of the user's hand 12. Control enclosure 16 consists of an upper shell 17 and lower shell 18 which, when coupled together, form a cavity within which the controls for the vibrating motors and the power supply are contained, a subject which will be discussed in detail hereinbelow.

Central segment 15 extends forwardly into a middle finger extension 20 and thumb extension 21. As can be seen in FIGS. 1, 2 and 3, motor housing 22 is disposed through and secured to the terminus of middle finger extension 20. In a like manner, motor housing 23 is disposed through and secured to thumb extension 21.

The mounting of motor housing 22 to middle finger extension 20 may be best seen in FIG. 4. Motor housing 22 consists of upper and lower housing shells 24 and 25 which, when coupled together, define a cavity 27 within which a vibrating motor is mounted. In order to mount motor housing 22 to middle finger extension 20, an aperture is disposed through the top and bottom layers 13 and 14 of middle finger extension 20. Conventional self-locking pins 26 are formed along the perimeter of lower housing shell 25, mating receptacles being formed in the perimeter of upper housing shell 24. The self-locking pins 26 are disposed through the margin of covering panel 11 adjacent the aperture disposed therethrough thereby locking motor housing 22 to finger extension 20 enclosing the aperture disposed through middle finger extension 20. Although the preferred embodiment of the present invention employs a motor housing 22 which incorporates conventional self-locking pins, it is understood other conventional means may be employed to couple motor housing 22 to middle finger extension 20.

As can be seen in FIG. 3, motor housing 23 consists of an upper housing shell 30 and lower housing shell 31. The construction of motor housing 23 is typically identical to that of motor housing 22 which is illustrated in FIG. 4. Motor enclosure 23 is coupled to thumb extension 21 and control enclosure 16 is coupled to the central segment 15 of covering panel 11 in the same manner as described with respect to motor housing 22.

Central segment 15 extends rearwardly into a strap 35 which is adapted to be secured about the wrist of the user's hand 12 in the manner shown in FIG. 1. Strap 35 is formed by a pair of securing elements 36 and 37 which extend laterally in opposition to each other in a manner which is substantially perpendicular to the longitudinal axis of massage apparatus 10. In a preferred embodiment, a hook and loop fastener 38 (commonly sold under the trademark Velcro®) is used to fasten or join the securing elements 36 and 37. It is to be understood, however, that other conventional fastening means can be employed, including, for example, one or more snaps, buttons, or zippers.

As stated above, the present invention provides a plurality of vibrating motors which transmit vibratory motion directly to the fingers of the user. In the preferred embodiment of the present invention, a pair of vibrating motors are coupled to middle finger extension 20 and thumb extension 21 disposed directly adjacent the middle finger and thumb of a user. However, it is understood the scope of the present invention contemplates use of more than a pair of vibrating motors mounted adjacent any two or more of the fingers or thumb of the user.

An understanding of the vibrating motors and the manner in which their vibratory motion is transmitted to the fingers of the user may be best understood by reference to FIGS. 4 and 6. FIG. 4 illustrates a partial cross-sectional view of the motor housing 22 positioned at the end of middle finger extension 20. As stated, it is understood the structure of motor housing 23 disposed at the terminus of thumb extension 21 is identical to motor housing 22.

Motor housing 22 is a substantially cylindrical enclosure within which a vibrating motor 50 (FIG. 6) is mounted. The interior cavity of upper housing shell 24 is semi-cylindrical. In a like manner, the interior cavity of the lower housing shell 25 is semi-cylindrical. As discussed hereinabove, the upper and lower housing shells 24 and 25 may be coupled to one another through conventional self-locking pins and receptacles. When upper and lower housing shells 24 and 25 are engaged, the plane of covering member 11 and top and bottom layers 13 and 14 will substantially bisect the cylindrical profile of the interior of upper and lower housing shells 24 and 25. A pair of motor mounts 40 and 41 are centrally located along the interior cavity of upper housing shell 24. In a like manner, a pair of motor mounts 42 and 43 are centrally located along the interior cavity of lower housing shell 25. Motor mounts 40, 41, 42 and 43 are adapted to rigidly secure a vibrating motor within motor housing 22 to maximize the transmission of vibratory motion emanating from the motor 50 through motor housing 22 to the user's fingers.

The preferred embodiment of the present invention employs a pair of identical vibrating motors 50 mounted within motor housings 22 and 23. The structure for each of the vibrating motors 50 may be best understood by reference to FIG. 6. Each vibrating motor comprises a vibrating, direct current motor 50. Vibrating motor 50 comprises a cylindrical body 51 having a pair of rotatable shafts 52 and 53 axially extending therefrom in opposition to each other. In the preferred embodiment of the present invention, a pair of eccentric cams 54 and 55 are secured at the ends of shafts 52 and 53, respectively. Eccentric cams 54 and 55 are permanently secured to shafts 52 and 53, respectively, the weight thereof being sufficient to generate intense, mechanical vibrations. Although the preferred form of the present invention employs a vibrating motor which employs a pair of eccentric cams 54 and 55, it is understood a vibrating member employing only a single eccentric cam may be used in lieu thereof. Electrical lead wires 56 extend through the interface between upper and lower semi-cylindrical members 24 and 25 and are disposed between top and bottom layers 13 and 14 of covering panel 11 to central enclosure 16. When direct current motor 50 is activated, the rotation of the eccentric cams 54 and 55 will cause the motor enclosure 22 to vibrate. The vibrations of the motor enclosure 22 will be transmitted to the user's fingers.

In order to maximize the transmission of the vibratory motion of motors 50 to the fingers of the user, it is essential to create a firm but comfortable coupling between the user's fingers and motor housings 22 and 23. The present invention employs cylindrical, elastic straps or cords 60 and 61 which are coupled to motor housings 22 and 23, respectively. It is recognized that the size of a user's fingers will vary. In order to create a coupling between the present invention and the user's fingers which is comfortable and efficient, means are provided to easily change the elastic straps 60 and 61 which are employed.

As can be seen in FIG. 4 and FIG. 5, a central, elongated extension or longitudinal projection 63 extends inwardly from the lower terminus of side wall 64. Longitudinal projection 63 is uniformly spaced from bottom wall 65. In the preferred form of the present invention, longitudinal projection 63 includes tab 66 which is integral with bottom surface 67 of motor housing 25. The opposite end 68 of longitudinal projection 63 frictionally engages the adjacent edge of bottom surface 67.

As can be seen in FIG. 4, the elastic band 60 may be removeably inserted over longitudinal projection 63, the diameter of the elastic band 60 being appropriately sized to conform to the size of the user's finger. It is understood the structure of the lower housing shell 31 of motor housing 23 is identical to that shown in FIG. 4 thereby permitting the user to vary the size of elastic band 61 to fit the needs of the user.

In the preferred embodiment, vibrating motors 50 are DC current motors, powered by a DC power source 70, typically in the form of batteries (FIG. 7). Thus, the finger massage apparatus is "cordless" and very convenient to use. Preferably, the batteries are of the rechargeable type, such as nickel-cadmium batteries. When rechargeable batteries are used, it is preferred that the power supply also include an electrical connection inlet for coupling to an external electrical power supply.

Each of the vibrating motors 50 is disposed in one of the motor housings 22 or 23. DC power source 70 is concurrently coupled to a pair of controllers 71 and 72, each of which may independently control the voltage and current being applied to the respective vibrating motors 50 mounted within motor housings 22 and 23. DC power source 70 and controllers 71 and 72 are mounted within controller enclosure 16.

Controllers 71 and 72 may be implemented through the use of a variety of conventional voltage and current control elements such as variable resistors or semiconductor switches, all of which are well known in the art. By independently controlling the voltage or current applied to the vibrating motors 50 mounted within motor housings 22 and 23, the user may vary the application, orientation and magnitude of the vibratory motion in a manner which may not be achieved by any device taught by the prior art. In the preferred embodiment of the present invention, controllers 71 and 72 are implemented through a pair of variable resistors operated by rotatable switches 73 and 74. In operation, power to the vibratory motor 50 in motor housing 22 is effected by the positioning of rotatable switch 73. In a like manner, rotatable switch 74 is used to activate and set the operating level for the vibratory motor 50 mounted within motor housing 23. By setting the selected operating levels through rotatable switches 73 and 74, the vibrating motors 50 mounted in motor housings 22 and 23 will determine the intensity of the vibratory motion transmitted through the respective fingers of the user.

The present invention has been described with reference to a preferred embodiment, but is not limited thereto. Workers skilled in the art and technology to which this invention pertains will appreciate that alterations and changes in the described construction and operation of the invention can be made without meaningfully departing from the principle, spirit and scope of this invention. For example, although it is preferred to provide a separate vibrating motor controller for each vibrating motor, it is recognized that the finger massage apparatus can be constructed using a single controller to regulate the magnitude and rate of vibration of all of the vibrating motors. Other alterations and changes are possible. Accordingly, the foregoing description should not be read as pertaining only to the precise embodiment described herein but, rather, should be read consistent with and as support for the following claims, which are to have their fullest, fair scope.

I claim:

1. A finger massage apparatus mountable on the hand and wrist of a user, comprising:

a control enclosure having a top surface and a bottom surface and including a rotatable control switch;

means for securing the control enclosure to the user, said means comprising a strap having hook and loop fasteners for securing the strap around the user's wrist;

a motor housing comprising an upper motor housing member and a lower motor housing member coupled together to form a motor housing cavity therebetween;

a vibrating motor contained within the motor housing cavity for providing vibrations to the user's fingers;

insulated electrical lead wires extending forwardly from the control enclosure to the motor, said insulated lead wires being housed within a resilient member adapted to hide the insulated lead wires from view;

one or more annular coupling members for securing the motor housing to the user's finger, each coupling member attached to the motor housing and adapted to wrap around and snugly engage a single finger of the user;

a power source housed within the control enclosure and electrically coupled to the vibrating motor by the electrical lead wires; and a motor controller housed within the control enclosure for regulating electric current delivered from the power source to the motor, said motor controller comprising a current control element coupled to the rotatable control switch, whereby vibration intensity induced by the motor can be varied through rotation of the switch.

2. The finger massage apparatus of claim 1 wherein each of said one or more annular coupling members is in contact with the lower motor housing member.

3. A finger massage apparatus mountable upon the hand of a user comprising:

(a) a plurality of vibrating members, each member including a motor housing having a top and bottom shell, each shell having an interior and exterior surface, the interior surfaces of said top and bottom shells defining a cavity therebetween, and each cavity containing a vibrating motor mounted therein;

(b) resilient receiving means for securing each vibrating member to a user's finger or thumb, coupled to the exterior surface of the bottom shell of each of said vibrating members;

(c) a vibrating motor power source;

(d) a plurality of motor controllers, each being connected intermediate the vibrating motor power source and one of said vibrating motors; and (e) securing means for removeably mounting said motor controller and said vibrating motor power source to the hand of a user.

4. A finger massage apparatus as defined in claim 3 wherein said resilient receiving means comprises (i) an a longitudinal projection integral with the exterior surface of the bottom shell of said motor housing and being in parallel spaced relation thereto and (ii) an elastic loop removeably disposed about said longitudinal projection adapted to receive the finger of a user therethrough.

5. A finger massage apparatus as defined in claim 3 including a controller housing consisting of a top and bottom shell and defining a cavity therebetween, said vibrating motor power source and motor controllers being mounted within the cavity defined by the top and bottom shells of said motor controller.

6. A finger massage apparatus as defined in claim 5 wherein said securing means comprises a resilient panel having a central segment, said central segment extending forwardly into a plurality of elongated extensions adapted to be disposed adjacent to a user's fingers or thumb, said central segment extending rearwardly into a securing strap adapted to encircle the wrist of the user, said resilient panel having a plurality of apertures disposed there-through at the terminus of each said elongated extension, each aperture being adapted to receive a motor housing, and said resilient panel also having an aperture disposed therethrough at said central segment and being adapted to receive said controller housing.

7. A finger massage apparatus as defined in claim 6 wherein the plurality of elongated extensions comprises a thumb extension and a finger extension, each of said thumb and finger extensions adapted to hold the bottom shell of a motor housing adjacent the terminus of the thumb and a finger of the user.

8. A finger massage apparatus mountable upon the hand of a user comprising:

(a) a resilient panel having a top and a bottom surface, the bottom surface being adapted to be mounted upon the hand of the user consisting of a central segment extending forwardly into elongated thumb and finger extensions, first and second apertures being disposed through the thumb and finger extensions respectively at the forward terminus thereof, a third aperture being disposed through said panel within said central segment;

(b) first and second motor housings, each comprising top and bottom shells defining a cylindrical cavity therebetween, each bottom shell including a planar bottom surface and an elongated flange extending in parallel spaced relation thereto, said first and second motor housings being disposed within the first and second apertures and respectively secured to the adjacent margins of the thumb and finger extensions of said panel;

(c) elastic securing means for mounting about fingers of the user adapted to be disposed about the elongated flange of each of said first and second motor housings;

(d) first and second vibrating motors coupled within the cavities defined by the top and bottom shells of said first and second motor housings, respectively;

(e) a vibrating motor power source;

(f) first and second motor controllers coupled intermediate said vibrating motor power source and the first and second vibrating motors, respectively; and (g) a controller housing consisting of a top and bottom shell defining a cavity therebetween, said vibrating motor power source and said first and second motor controllers being mounted within said controller housing, said controller housing being disposed within the third aperture and secured to the adjacent margin of the central segment of said panel.

9. A finger massage apparatus as defined in claim 8 wherein said elastic securing means comprises an adjustable, elastic loop adapted to be removeably disposed upon said elongated flange whereby said first and second motor housings are secured to the thumb and finger of the user.

10. A finger massage apparatus as defined in claim 8 wherein said resilient panel comprises first and second members in uniform contact with one another, the connections between said motor controllers and said vibrating motors being disposed between said first and second members.

11. A finger massage apparatus as defined in claim 8 wherein said resilient panel extends rearwardly from said second segment into a strap adapted to be secured about the wrist of the user.

12. A finger massage apparatus mountable upon the hand of a user, comprising:

(a) a pliable glove panel having a central segment, finger extension, thumb extension, and strap;

(b) a first vibrating motor, secured to the finger extension;

(c) a second vibrating motor, secured to the thumb extension;

(d) a vibrating motor power source, electrically coupled to said first and second vibrating motors; and (e) first and second motor controllers, electrically coupled to said first and second vibrating motors, respectively.

13. A finger massage apparatus as recited in claim 12 further comprising fastening means for securing the strap to a user's wrist.

* * * * *